US005133939A

United States Patent [19]

Mahe

[11] Patent Number: 5,133,939

[45] Date of Patent: Jul. 28, 1992

[54] TEST TUBE HOLDER AND TRAY ASSEMBLY

[75] Inventor: Stanley R. Mahe, Dubuque, Iowa

[73] Assignee: Barnstead Thermolyne Corporation, Dubuque, Iowa

[21] Appl. No.: 673,080

[22] Filed: Mar. 21, 1991

[51] Int. Cl.[5] ..... B01L 9/06

[52] U.S. Cl. ..... 422/104; 422/297; 422/300; 211/71; 211/74; 435/809

[58] Field of Search ..... 422/104, 297, 300; 211/60.1, 70.1, 71, 72, 74; 435/287, 809

[56] References Cited

U.S. PATENT DOCUMENTS

| | | | |
|---|---|---|---|
| 1,188,146 | 6/1916 | Bogley | 211/74 |
| 3,375,934 | 4/1968 | Bates | 211/74 X |
| 3,379,315 | 4/1968 | Broadwin | 211/74 |
| 3,604,566 | 5/1971 | Ram | 211/74 |
| 3,643,812 | 2/1972 | Mander et al. | 211/74 |
| 3,709,429 | 1/1973 | McKenzie et al. | 211/74 X |
| 3,940,249 | 2/1976 | McClurg | 422/104 X |
| 4,124,122 | 11/1978 | Emmett | 211/74 |
| 4,256,697 | 3/1981 | Baldwin | 422/104 |
| 4,281,768 | 8/1981 | Sommers | 211/74 |
| 4,284,603 | 8/1981 | Korom | 422/101 |
| 4,389,374 | 6/1983 | Sutton et al. | 422/104 |
| 4,407,958 | 10/1983 | DeGraff, Jr. | 435/287 |
| 4,453,639 | 6/1984 | Sharma | 422/104 X |

*Primary Examiner*—Lynn M. Kummert

*Attorney, Agent, or Firm*—Wood, Herron & Evans

[57] ABSTRACT

A test tube holder and tray assembly designed for use with a dri-bath incubator. The test tube holder comprises a top shelf which comprises a rigid top plate and a sheet of flexible material secured to the rigid plate having a second plurality of openings which are aligned with the openings in the top plate. The openings in the elastomeric material are slightly smaller than the test tubes such that when test tubes are placed therethrough a frictional engagement is provided so as to maintain the test tubes in the desired position. A bottom shelf is spaced from the top shelf and secured thereto. A tray is provided for holding the test tube holder and allows pre-positioning of test tubes therein so that the test tube holder and test tubes placed therein can be used directly with a dri-bath incubator.

22 Claims, 5 Drawing Sheets

TEST TUBE HOLDER AND TRAY ASSEMBLY

BACKGROUND OF THE INVENTION

The present invention is directed to a holder and tray assembly for holding test tubes and other similar type articles in a manner which permits the easy manipulation and transportation of the tubes in a safe and secure manner and for pre-positioning of the test tubes so that the test tube can be quickly and easily used in a dri-bath incubator.

In the prior art, test tube holders are typically used for transporting of test tubes and are often placed in a water bath or laboratory incubator. However, these typical prior art test tube holders do not lend themselves to providing easy, simultaneous insertion of test tubes into a dri-bath incubator. At the present time, when test tubes are to be placed into the heating block of a dri-bath incubator, the tubes must be individually taken from the rack and placed in the wells provided in the heating block for receiving the test tubes.

Various methods for biological and chemical analysis and culture testing require the extensive handling, manipulation and transporting of rack held test tubes. It is very desirable that the test tubes be held firmly in position in the holder during this transportation and manipulation. Various systems have been suggested in which to firmly hold the test tube within the rack such as illustrated in U.S. Pat. No. 4,124,122. The '122 reference uses a plurality of individual O-ring type structures associated with each individual hole. The O-ring is made out of a resilient material which frictionally engages the periphery of a test tube and holds it securely in position in the rack. This holder is a relatively complex configuration requiring relatively expensive manufacturing techniques and is limited only to the transporting of test tubes. Tubes must be individually removed and then placed in a well of an appropriate heating block of a dri-bath incubator.

The present invention provides a novel test tube rack and tray assembly which includes means for the prepositioning of test tubes and for the simultaneous insertion of test tubes in the heating block of a dri-bath incubator. Additionally the test tube holder has means for firmly and securely holding the test tubes during transportation and manipulation of the holder, which is simple in construction and easy to manufacture.

SUMMARY OF THE INVENTION

In one aspect of the present invention there is provided a test tube holder comprising a top shelf and bottom shelf spaced therefrom. The top shelf comprising a first plate made of a rigid material and a sheet of flexible material disposed beneath the first plate. The rigid plate has a first plurality of openings for allowing passage of test tubes therethrough. The flexible sheet has a second plurality of openings which are in vertical alignment with the first plurality of openings in the top plate. The openings in the first plate are greater in size than the outer diameter of the test tubes which are to be placed therethrough. The second plurality of openings in the flexible resilient sheet have a size which is slightly smaller than the test tubes such that a frictional engagement is provided of sufficient force so as to maintain the test tubes at any desired position.

In a second aspect of the present invention there is provided a test tube holder and tray assembly. The test tube holder includes a top shelf comprising a top plate made of a rigid material having a first plurality of openings for allowing passage of test tubes therethrough, a flexible sheet made of elastomeric material placed beneath the top plate, and a bottom plate placed beneath the bottom side of the flexible sheet. The flexible sheet has a second plurality of openings which are in vertical alignment with the first plurality of openings in the top plate and the bottom plate has a third plurality of openings therein which are aligned with the first and second plurality of openings. The first and third plurality of openings being of substantially similar size and are designed to be greater than the size of test tubes which are to be placed therethrough. The second plurality of openings in the flexible resilient sheet having a size slightly smaller than the test tubes which are to be placed through the openings such that a frictional engagement is provided of sufficient force so as to maintain the test tube at any desired position. The bottom plate, top plate and flexible sheet are secured together such that the flexible sheet is secured between the top plate and bottom plate. The holder includes a bottom shelf spaced from the top shelf. A tray is provided to receive the test tube holder and maintain the test tube holder in an upright position. The tray has a base portion and a pair of oppositely disposed support arms at the lateral ends of base portion. The upper arms each have recess for receiving and supporting the top shelf of the test tube holder. The arms have a height such that the test tubes may be placed through the first, second and third plurality of openings to a predetermined depth.

DESCRIPTION OF THE DRAWINGS

Referrring to FIG. 1, there is illustrated an exploded perspective view of a test tube holder and tray assembly made in accordance with the present invention.

DETAILED DESCRIPTION OF THE INVENTION

Figure 1:
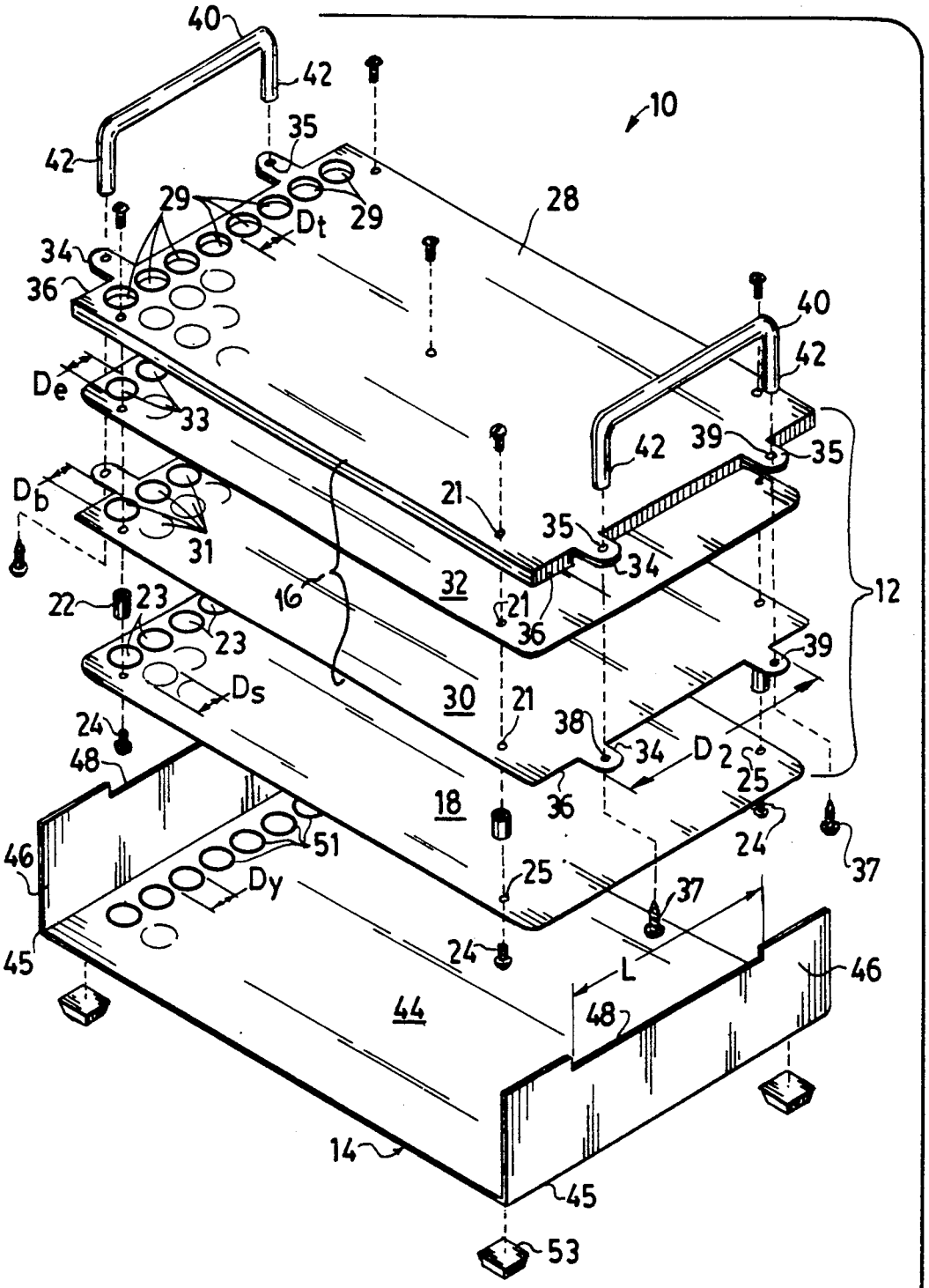
Figure 2:
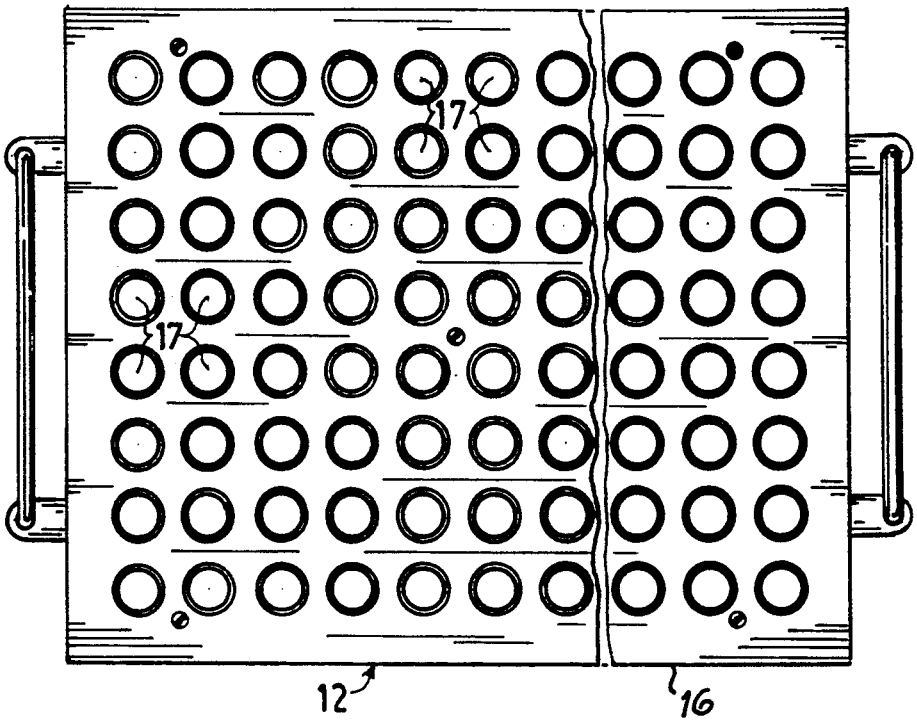
FIG. 2 is a top plan view, partially broken away, of the test tube holder of FIG. 1.

Referring to FIGS. 1–4, there is illustrated a test tube holder and tray assembly 10. The test tube holder and tray assembly includes a test tube holder 12 designed to rest upon tray 14. The test tube holder/rack comprises a top shelf 16 and a bottom shelf 18 which is disposed below the top shelf a distance D. In the particular embodiment illustrated, the bottom shelf 18 is secured to top shelf by a plurality of screws 19 which pass through openings 21 in top shelf 16 which engage spacers 22 disposed between the top and bottom shelves 16, 18. The bottom shelf 18 is secured to spacers 22 by a plurality of screws 24 which pass through respective openings 25 in bottom shelf 18 and which engage openings in spacers 22. It is, of course, understood that the bottom shelf may be secured to top shelf 18 in any desired manner.

The top shelf 16 is provided with a plurality of openings 17 (see FIG. 2) which, in the particular embodiment illustrated, are provided in an array of 8 rows and 12 columns such that 96 openings 17 are provided. Not all of the openings 17 are illustrated in the drawings for the sake of simplicity and clarity. The particular spacing and arrangement of openings 17 are designed to correspond with the pattern in which openings are provided in the heating block of a dri-bath incubator, as will be discussed later herein. It is, of course, understood that the number and pattern of openings 17 be varied as desired to meet the needs of the user.

Figure 3:
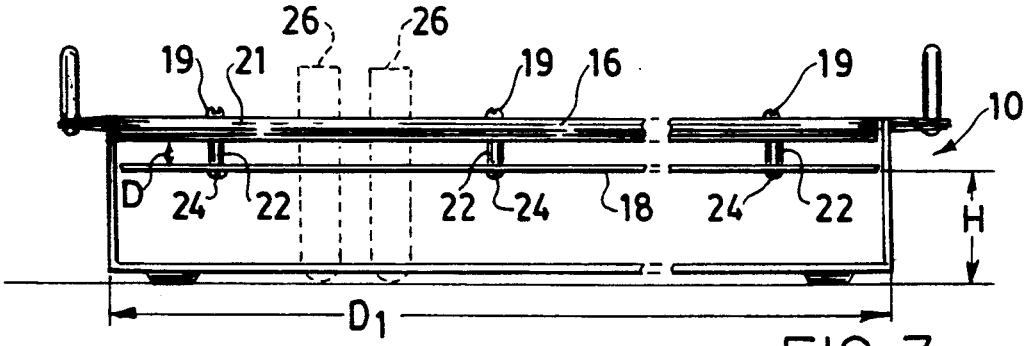
FIG. 3 is a front elevational view of the test tube holder and tray assembly of FIG. 1.
Figure 4:
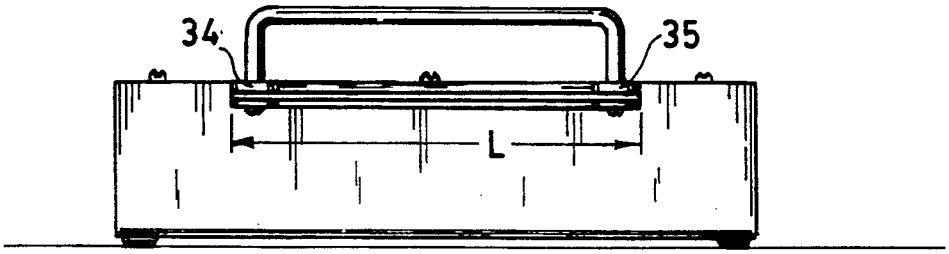
FIG. 4 is a side elevational view of the test tube holder and tray assembly of FIG. 1.

The bottom shelf 18 is also provided with a plurality of openings 23 which are arranged so that they align with the array of openings 17 in top shelf 16 such that a test tube 26, or other similar-like articles, when inserted will be aligned vertically such as illustrated by the dash lines in FIG. 3.

The top shelf 16 comprises a rigid top plate 28 which has a plurality of openings 29 having a diameter Dt which form a part of openings 17 in top shelf 16. The top shelf also includes a rigid bottom plate 30 which has an array of openings 31 having a diameter Db which also forms a part of openings 17. A flexible sheet 32 is placed between top and bottom plates 28,30. The flexible sheet 32 also has a plurality of openings 33 having a diameter De which align and complete openings 17. In the preferred embodiment illustrated, rigid plates 28,30 are made of metal.

The bottom and top plates 28,30 are secured together such that the flexible sheet 32 is firmly secured between top and bottom plates 28,30. In the particular embodiment illustrated, the top and bottom plates 28,30 include a pair of projections 34,35 extending from each lateral end 36 of rigid plates 28,30. The projections 34,35 each have an aligned opening 38,39 through which a screw 37 passes and engages a handle 40 placed on top plate 28 such that when screws 37 are securely threaded into openings in ends 42 of handle 40 will cause the flexible sheet 32 to be firmly secured between plates 28,30. In addition to providing means for securely holding plates 28,30 together, the handles 40 also serve to provide means for carrying of the test tube holder 12 with the test tubes firmly placed therein.

The tray 14 includes a base section 44 and a pair of upstanding arms 46 located at the axial ends 45 of base section 44. The upstanding arms are designed to engage and support the test tube holder 12. The bottom section 44 is provided with a plurality of openings 51 which are arranged so as to align vertically with the array of openings 23 in bottom shelf 18 and openings 17 in top shelf 16. In the particular embodiment illustrated, the upstanding arms 46 are spaced apart a distance D1 such that the top and bottom shelves 16,18 can be disposed between upstanding arms 46. Each of the upstanding arms 46 are provided with a recessed section 48 which are designed to receive and support the projections 34,35 of top shelf 16. The length L of recess section 48 is designed to be equal to the distance D2 between the projections 34,35 so as to provide indexing means between the top shelf and tray so that openings 51 in tray 14 align vertically with the openings 23,17 in bottom shelf 18 and top shelf 16, respectively. The bottom section 44 includes a plurality of feet which are designed to space the bottom section 44 a predetermined distance from the supporting surface upon which the tray 14 is placed, e.g., table or laboratory work bench. The openings 17,23 and 51 are designed to allow a test tube 26 to pass therethrough such that the test tube 26 may be easily inserted or removed, yet is firmly held in position at the desired position such that test tube 26 can be pre-positioned at a predetermined height such that the test tube holder 12 with an array of test tubes 26 placed therein can be quickly and easily inserted into a dri-bath incubator. The openings 17 in top shelf 16 are designed so that test tubes 26 placed therein are firmly held in position at the desired height. The diameter Dt, Db and Ds of holder 12 are sized to be greater than the diameter Dtt of test tubes 26 whereas the diameter De of openings 33 are smaller than the diameter Dtt of test tubes 26 to allow easy passage therethrough so that a friction engagement occurs between the flexible elastomeric sheet 32 and test tubes 26. By properly selecting the size of openings Dt, Db, Ds and De, the test tubes can be easily inserted and removed yet provide a sufficient degree of resistance to firmly hold the test tubes 26 and the contents thereof firmly in position for transport and manipulation.

The size of openings 23, 29, 31, 33 and 51 of test tube holder and tray assembly 10 are selected to be used with a particular size and type test tube. For example, for a glass test tube having a diameter Dtt of about 0.470 inches ±0.005 inches, the diameter Dt and Db of openings 29 and 31, respectively, is 0.594 inches, the diameter De of openings 33 is 0.422 inches. The diameter Dt, Ds of the openings 51,23 in tray 44 and bottom shelf 18 are 0.50 inches. As it can be seen from the foregoing, diameter De of the elastomeric sheet 32 is smaller than the diameter Dtt of the test tube. Thus, as the test tube 26 is placed therethrough, a frictional engagement will occur between the sheet 32 and test tube 26. It can also be seen that the openings Dt of top plate and bottom plate 28,30 are substantially larger than the diameter of the test tube 26. In the particular embodiment illustrated, the elastomeric sheet is made out of a silicone rubber having a thickness of about 0.013±0.016 inches. Applicants have found that silicone rubber may be purchased from CHR Industries. It is, however, to be understood that the elastomeric sheet may be made of any appropriate elastomeric material.

When plastic test tubes are to be used in test tube holder and tray assembly 10, the diameters Dt, De, Dy, and Ds may need to be varied slightly. For example, for a plastic test tube having an outside diameter Dtt of about 0.450 inches±0.010 inches, the openings 29 preferably have a diameter Dt of about 0.562 inches, the openings 33 of the elastomeric sheet 32 have a diameter De of about 0.422 inches, the openings 51 of tray has a diameter Dy of about 0.50 inches and the openings 23 of bottom shelf 18 have a diameter Ds of about 0.50 inches.

The particular size of openings in the top plate, bottom plate, bottom shelf and tray are selected such that the test tube can freely pass through, yet be frictionally engaged by the elastomeric sheet such that the test tube 26 can be easily placed therethrough, yet provide sufficient friction such that the test tube 26 is not damaged and is capable of being held in the position at which the user positioned the test tube 26.

Figure 5:
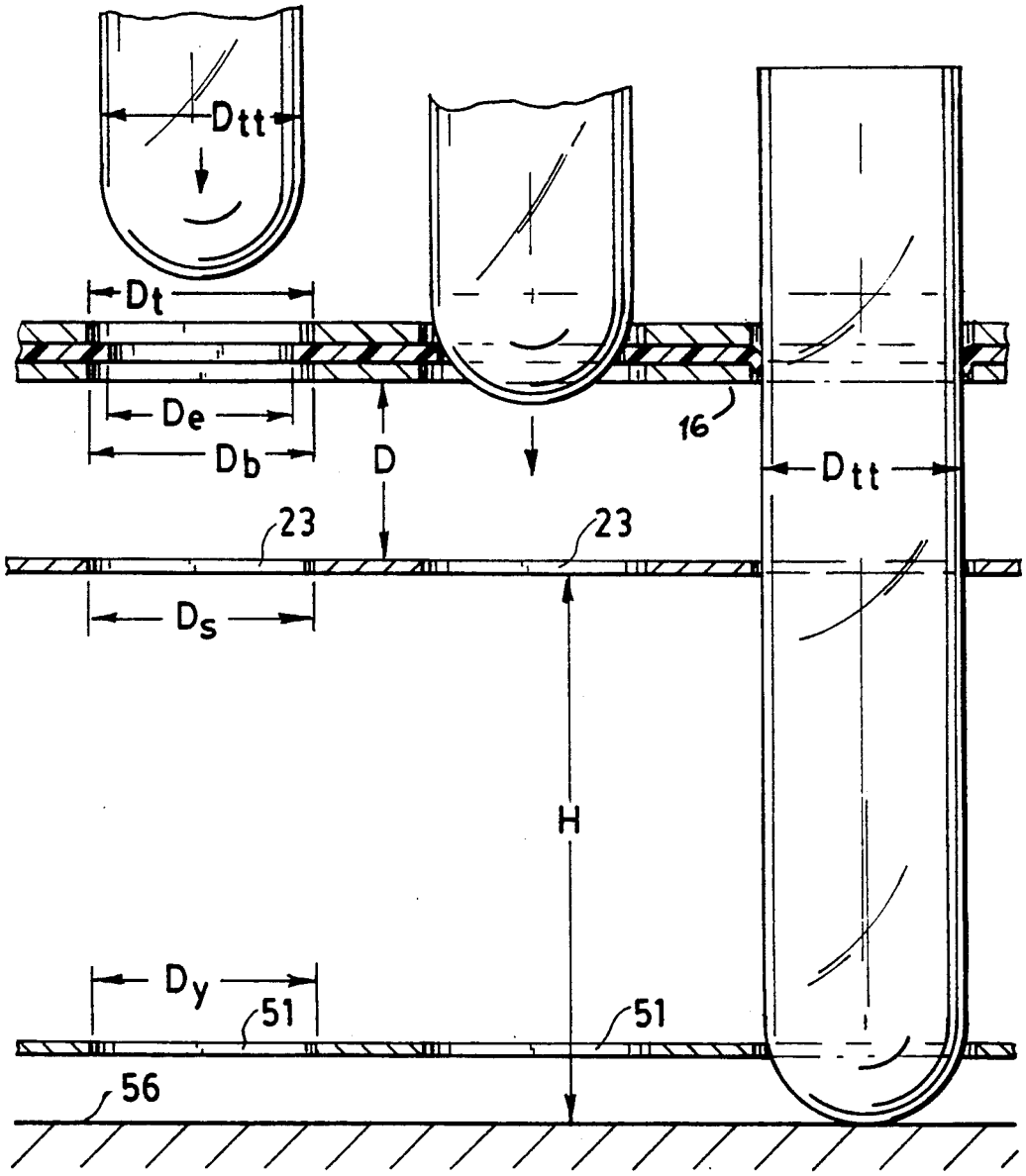
FIG. 5 is an enlarged fragmentary view of FIG. 3 illustrating how a test tube is inserted into the test tube holder and tray assembly of FIG. 1.
Figure 6:
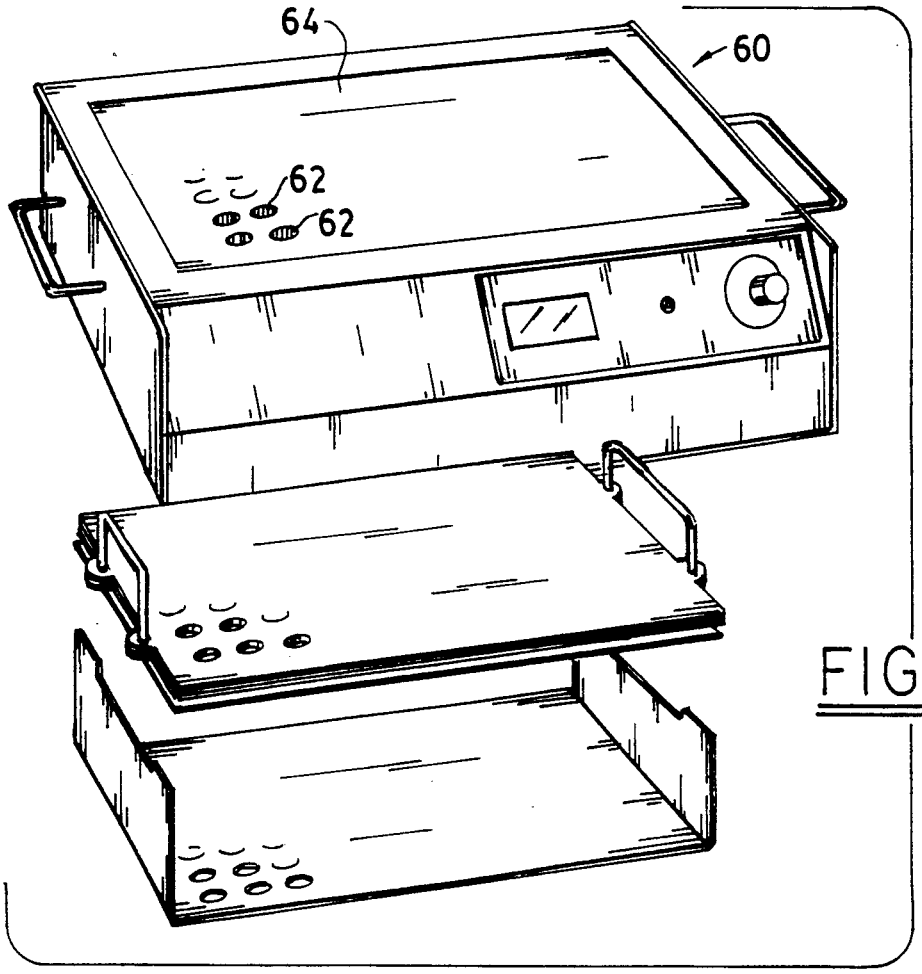
FIG. 6 is a perspective view of a test tube holder and tray assembly of the present invention and a dri-block incubator with which the test tube holder of the present invention is designed to be used.
Figure 7:
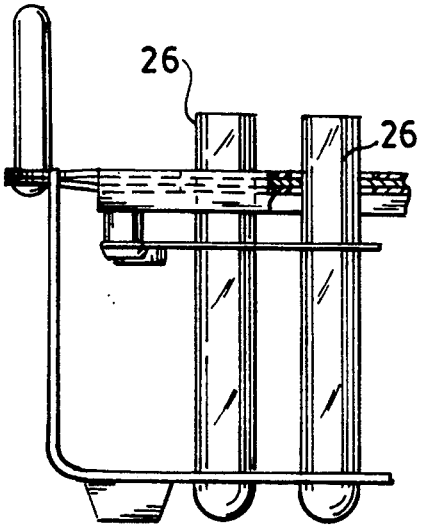
FIG. 7 is a partial front elevational view of the test tube holder and tray assembly illustrating two test tubes pre-positioned for later placement in the heating block of a dri-bath incubator.
Figure 8:
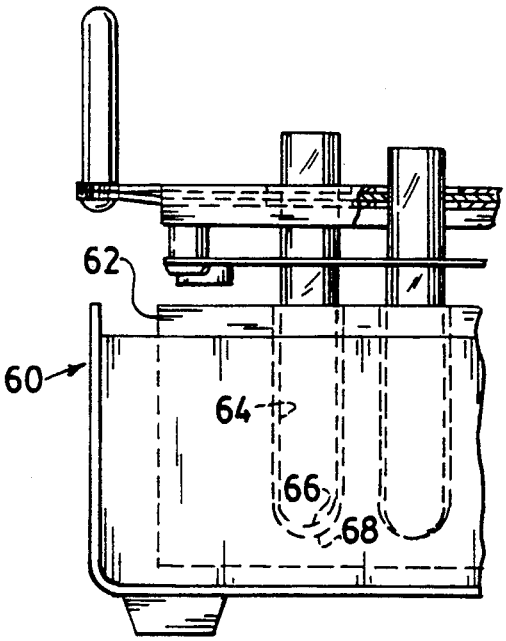
FIG. 8 is a partial elevational view similar to FIG. 7 illustrating the test tube holder with test tubes as it is being placed on the dri-block heating incubator of FIG. 6.
Figure 9:
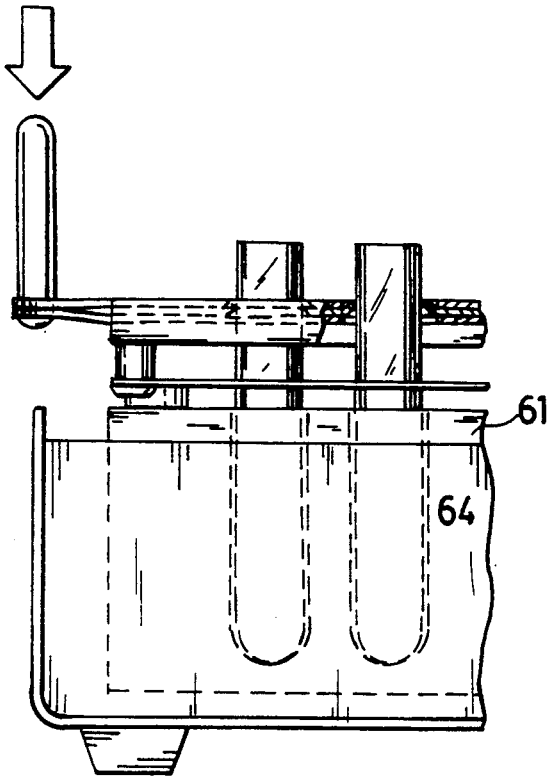
FIG. 9 is a view similar to FIG. 8 illustrating how the test tube holder is inserted within the dri-block incubator.
Figure 10:
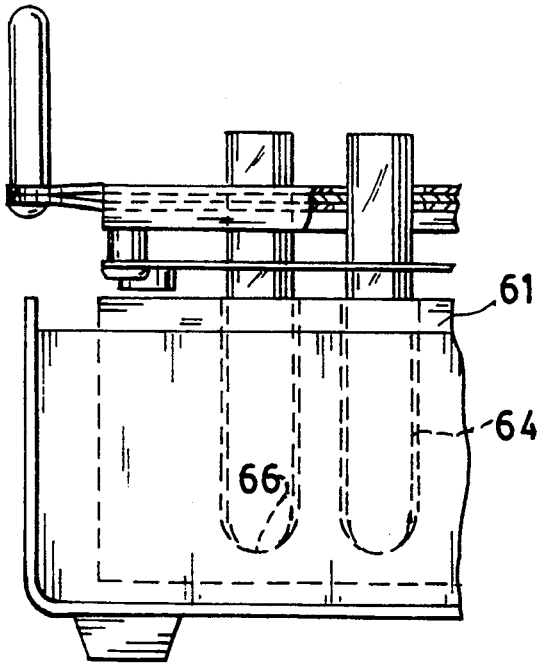
FIG. 10 is a view similar to FIGS. 8 and 9 illustrating the relative position of the test tube holder in the dri-block heating device after it has been finally seated.

In order to more fully understand the present invention, a brief description of the operation thereof will now be discussed. The user places the desired number of test tubes 26 through openings 17 in top shelf 16 and openings 23 in bottom shelf 18 until the test tubes 26 extends through the openings 51 in tray 44. The test tubes 26 are pushed down until they engage the top surface 56 upon which the tray 44 is placed (see FIG. 5). After all the test tubes 26 have been positioned, the test tubes 26 will extend a predetermined distance H below the bottom shelf 18. It is, of course, understood that the height of the arms 46 may be adjusted to provide the desired predetermined height H. Since the table upon which the tray is placed is typically flat, all the test tubes 26 that are placed in the test tube holder will extend a predetermined distance H below bottom shelf. After all the test tubes 26 have been finally positioned in the test tube holder 12, the holder 12 is lifted by its handles 40 carrying the test tubes that have been inserted within the openings and transported to the incubator. As previously discussed, the array of openings in top and bottom shelves 16,18 are such that they correspond and align with the openings/wells 62 in heating block 61 of dri-bath incubator 60. The test tube holder 12 is positioned so that the test tubes 26 will align with the openings 62 in the heating block and is then pushed down as illustrated in FIG. 9. The distance which the test tubes 26 extend below the bottom shelf 18 is slightly larger than the depth of the receiving wells 62 of heating block 61 in which the test tubes 26 have been placed. Thus, the test tubes 26 will be pushed down such that the bottom 66 of the test tubes 26 will firmly rest against the bottom 68 of wells 62 in heating block 61 as illustrated in FIG. 8. This will take into account any variation in the depth of wells 62 that may occur. Thereafter, the user releases the handles 40. Due to the elastomeric nature of the elastomeric sheet 32, the test tube holder will move slightly upward lifting the holder 12 away from the heating block 61. All the test tubes 26 remain seated. Thus, no contact occurs between the holder 12 and heating block 61. Only the flexible material contacts the tubes 26. The test tubes 26 are maintained within the heating block 61 for the desired period of time. Thereafter, the test tubes 26 are removed simultaneously and subjected to further analysis as required.

In the preferred embodiment illustrated, base section 44 is provided with openings 51 to allow test tubes to be placed therethrough. If desired, base section 44 may be stopped from any further movement. In such case the length of arms 46 can be adjusted so as to provide the desired distance which test tubes 26 extend below bottom shelf 18.

It is to be understood that various other changes and modifications can be made without departing from the scope of the present invention. For example, in the preferred embodiment illustrated, the flexible sheet 32 is sandwiched between two plates. Alternatively top shelf 16 may comprise only a single rigid plate against which a flexible elastomeric sheet 32 is adhesively secured. The present invention being defined by the following claims.

I claim:

1. A test tube holder comprising:

a top shelf comprising a top plate made of a rigid material having means defining a first plurality of openings for allowing passage of test tubes therethrough, a flexible sheet made of elastomeric material placed beneath said top plate, said flexible sheet having means defining a second plurality of openings which are in vertical alignment with said first plurality of openings in said top plate, a bottom plate made of a rigid material placed beneath a bottom side of said flexible sheet, said bottom plate having means defining a third plurality of openings therein which are aligned with said first and second plurality of openings in said top plate and flexible sheet respectively, said first and third plurality of openings being of substantially similar size and being designed to be greater than the size of test tubes which are to be placed therethrough, said second plurality of openings in said flexible resilient sheet having a size slightly smaller than test tubes which are to be placed therethrough such that a frictional engagement is provided of sufficient force so as to maintain test tubes at any desired position, means for securing said top plate, flexible sheet and bottom plate together such that said flexible sheet is sandwiched between said top plate and bottom plate;

a bottom shelf spaced vertically from said top shelf;

means for securing said bottom shelf to said top shelf in spaced apart relationship.

2. A test tube holder according to claim 1 wherein said top shelf is provided with a pair of handles so that said test tube holder may be lifted and moved as desired.

3. A test tube holder according to claim 1 wherein said top plate and bottom plate are made of metal and said flexible sheet is made of a silicone rubber.

4. A test tube holder according to claim 1 wherein said flexible sheet is made of a silicone rubber.

5. A test tube holder according to claim 1 wherein said flexible sheet is made out of silicone rubber and has a thickness of about $0.031 \pm 0.016$ inches.

6. A test tube holder according to claim 1 wherein said top and bottom plate are made of metal.

7. A test tube holder according to claim 1 wherein a tray is provided to receive said test tube holder and maintain said test, tube holder in an upright position, said tray having a base portion and a pair of oppositely disposed support arms at lateral ends of said base portion, each of said support arms having recesses for receiving and supporting said top shelf of said test tube holder, said arms having a height such that test tubes may be placed through said first, second and third plurality of openings to a predetermined depth.

8. A test tube holder according to claim 1 wherein a tray is provided to support said test tube holder, said, tray having means for supporting said test tube holder in an upright position at a predetermined height.

9. A test tube holder according to claim 8 wherein said means for supporting said test tube holder comprises a pair of spaced upright arms, said arms each having a recess for receiving indexing means on said test tube holder.

10. A test tube holder according to claim 9 wherein said indexing means comprises at least one projection provided in each lateral end of said top shelf for mating with a respective said recess in said arms.

11. A test tube holder according to claim 1 further comprising a support tray having a base support and means for supporting said test tube holder at a predetermined distance above said base support such that when said test tube holder is positioned on said tray test tubes may be inserted through said test tube holder and said tray until contacting the surface of said base support.

12. A test tube holder comprising:

a top shelf comprising of a first plate made of a rigid material having means defining a first plurality of openings for allowing passage of test tubes therethrough, a flexible sheet made of elastomeric material secured below said first plate, said flexible sheet having means defining a second plurality of openings which are in vertical alignment with said first plurality of openings in said first plate, said first plurality of openings being greater in size than test tubes which are to be placed therethrough, said second plurality of openings in said flexible resilient sheet having a size slightly smaller than test tubes which are to be placed through said openings such that a frictional engagement is provided of sufficient force so as to maintain test tubes at any desired position;

a bottom shelf spaced vertically from said top shelf;

means for securing said bottom shelf to said top shelf in spaced apart relationship.

13. A test tube holder according to claim 12 wherein said top shelf is provided with a pair of handles so that said test tube holder may be lifted and moved as desired.

14. A test tube holder according to claim 13 wherein said first plate and bottom shelf are made of metal and said flexible sheet is made of a silicone rubber.

15. A test tube holder according to claim 12 wherein said flexible sheet is made or a silicone rubber.

16. A test tube holder according to claim 12 wherein said flexible sheet is made out of silicone rubber and has a thickness of about $0.031 \pm 0.016$ inches.

17. A test tube holder according to claim 12 wherein said first plate and bottom shelf are made of metal.

18. A test tube holder according to claim 12 wherein a tray is provided to receive said test tube holder and maintain said test tube holder in an upright position, said tray having a base portion and a pair of oppositely disposed support arms at lateral ends of said base portion, each of said support arms having recesses for receiving and supporting said top shelf of said test tube holder, said arms having a height such that test tubes may be placed through said first and second plurality of openings to a predetermined depth.

19. A test tube holder according to claim 12 wherein a tray is provided to support said test tube holder, and means are provided for supporting said test tube holder in an upright position at a predetermined height.

20. A test tube holder according to claim 19 wherein said means for supporting said test tube holder comprises a pair of spaced upright arms on said tray, each of said arms having a recess for receiving indexing means on said test tube holder.

21. A test tube holder according to claim 20 wherein said indexing means comprises at least one projection provided in each lateral end of said top shelf for mating with a respective said recess in said arms.

22. A test tube holder and tray assembly comprising:

a tray having a top shelf comprising a top plate made of a rigid material having means defining a first plurality of openings for allowing passage of test tubes therethrough, a flexible sheet made of elastomeric material placed beneath said top plate, said flexible sheet having means defining a second plurality of openings which are in vertical alignment with said first plurality of openings in said top plate, a bottom plate made of a rigid material placed beneath a bottom side of said flexible sheet, said bottom plate having means defining a third plurality of openings therein which are aligned with said first and second plurality of openings in said top plate and flexible sheet respectively, said first and third plurality of openings being of substantially similar size and being designed to be greater than the size of test tubes which are to be placed therethrough, said second plurality of openings in said flexible resilient sheet having a size slightly smaller than test tubes which are to be placed therethrough such that a frictional engagement is provided of sufficient force so as to maintain test tubes at any desired position, means for securing said top plate, flexible sheet and bottom plate together such that said flexible sheet is sandwiched between said top plate and bottom plate; a bottom shelf spaced vertically from said top shelf; means for securing said bottom shelf to said top shelf in spaced apart relationship; and a tray for receiving said test tube holder and maintaining said test tube holder in an upright position, said tray having a base portion and a pair of oppositely disposed support arms at lateral ends of said base portion, each of said support arms having recesses for receiving and supporting said test tube holder, said arms having a height such that test tubes may be placed in said test tube holder through said first, second and third plurality of openings to a predetermined depth.

* * * * *